US007901029B2

(12) United States Patent
Baker

(10) Patent No.: US 7,901,029 B2
(45) Date of Patent: Mar. 8, 2011

(54) INK JET PRINTING APPARATUS HAVING ENHANCED PRINT HEAD MAINTENANCE

(75) Inventor: Richard Baker, West Lebanon, NH (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 476 days.

(21) Appl. No.: 11/292,888

(22) Filed: Dec. 2, 2005

(65) Prior Publication Data

US 2006/0139396 A1 Jun. 29, 2006

Related U.S. Application Data

(60) Provisional application No. 60/633,187, filed on Dec. 3, 2004.

(51) Int. Cl.
*B41J 2/165* (2006.01)

(52) U.S. Cl. ..... 347/22; 347/14; 347/41

(58) Field of Classification Search ..... 347/22, 347/86, 8, 43, 37, 14, 19, 23, 29–33, 41; 705/401

See application file for complete search history.

(56) References Cited

U.S. PATENT DOCUMENTS 5,587,730 A 12/1996 Karz et al.
6,164,747 A * 12/2000 Yashima et al. ..... 347/15
6,783,209 B2 * 8/2004 Gompertz ..... 347/43
7,086,716 B2 * 8/2006 Steinfield et al. ..... 347/32
7,654,635 B2 * 2/2010 Askeland et al. ..... 347/37
2002/0040354 A1 4/2002 Deshayes et al.
2003/0222939 A1 * 12/2003 Gompertz ..... 347/43
2004/0233241 A1 11/2004 Salacz

OTHER PUBLICATIONS

Third Office Action dated May 11, 2010 issued in co-pending Chinese application No. 2005800475762, 8 pgs.

Communication Pursuant to Article 94(3) EPC dated Feb. 22, 2010 issued in co-pending European application No. 05852735.9, 3 pgs.

* cited by examiner

*Primary Examiner*—Juanita D Stephens
(74) *Attorney, Agent, or Firm*—Fish & Richardson P.C.

(57) ABSTRACT

A method for ink jet printing includes moving one or more receivers along a printing pass, ejecting ink drops from a first ink jet print head on a first receiver region of the one or more receivers in the printing pass, ejecting ink drops from a second ink jet print head on a second receiver region of the one or more receivers in the printing pass, and providing maintenance to the first ink jet print head while the second ink jet print head ejects ink drops on the first receiver region or the second receiver region.

18 Claims, 2 Drawing Sheets

INK JET PRINTING APPARATUS HAVING ENHANCED PRINT HEAD MAINTENANCE

CROSS-REFERENCE TO RELATED APPLICATIONS

This application claims priority to U.S. Application Ser. No. 60/633,187, filed on Dec. 3, 2004.

TECHNICAL FIELD

This application relates to the field of ink jet printing.

BACKGROUND

Ink jet printing is a non-impact method that produces droplets of ink that are deposited on a substrate such as paper or transparent film in response to an electronic digital signal.

Ink jet printing systems generally are of two types: continuous stream and drop-on-demand. In continuous stream ink jet systems, ink is emitted in a continuous stream under pressure through at least one orifice or nozzle. Multiple orifices or nozzles also may be used to increase imaging speed and throughput. The ink is ejected out of orifices and perturbed, causing it to break up into droplets at a fixed distance from the orifice. At the break-up point, the electrically charged ink droplets are passed through an applied electric field which is controlled and switched on and off in accordance with digital data signals. Charged ink droplets are passed through a controllable electric field, which adjusts the trajectory of each droplet in order to direct it to either a gutter for ink deletion and recirculation or a specific location on a recording medium to create images. The image creation is controlled by electronic signals.

In drop-on-demand systems, a droplet is ejected from an orifice directly to a recording medium by pressure created by, for example, a piezoelectric device, an acoustic device, or a thermal device controlled in accordance with digital data signals. An ink droplet is not generated and ejected through the nozzles of an imaging device unless it is to be placed on the recording medium.

To keep print heads properly printing, the print heads need to be maintained from time to time. The maintenance operations may include cleaning and wiping of the nozzle plate, pumping and purging ink nozzles to remove air bubbles, and firing the ink nozzles etc. One undesirable aspect of the print head maintenance is that the maintenance reduces the time available for printing and therefore lowers printing throughput.

SUMMARY

In one aspect, the present invention relates to a method for ink jet printing, comprising:

moving one or more receivers along a printing pass;

ejecting ink drops from a first ink jet print head on a first receiver region of the one or more receivers in the printing pass;

ejecting ink drops from a second ink jet print head on a second receiver region of the one or more receivers in the printing pass; and providing maintenance to the first ink jet print head while the second ink jet print head ejects ink drops on the first receiver region or the second receiver region.

In another aspect, the present invention relates to a method for printing an ink image on a receiver, comprising:

moving one or more receivers along a printing pass;

receiving a first set of digital data by a first ink jet print head;

ejecting ink drops from the first ink jet print head on a first receiver region of one or more receivers in the printing pass in response to the first set of data;

receiving a second set of digital data by a second ink jet print head;

ejecting ink drops from the second ink jet print head on a second receiver region of one or more receivers in the printing pass in response to the second set of data;

altering the first set of digital data sent to the first ink jet print head in response to a maintenance call to the first ink jet print head;

altering the second set of digital data sent to the second ink jet print head in response to the maintenance call to the first ink jet print head; and providing maintenance to the first ink jet print head while the second ink jet print head ejects ink drops on the first receiver region or the second receiver region.

In yet another aspect, the present invention relates to a method for ink jet printing, comprising:

moving one or more receivers along a printing pass;

ejecting ink drops from a first group of ink jet print heads on a first receiver region of the one or more receivers in the printing pass;

ejecting ink drops from a second group of ink jet print heads on a second receiver region of the one or more receivers in the printing pass; and providing maintenance to at least one ink jet print head in the first group of ink jet print heads while the rest of the ink jet print heads in the first group of ink jet print heads eject ink drops on the first receiver region and the second group of ink jet print heads eject ink drops on the second receiver region.

In still another aspect, the present invention relates to an ink jet printing apparatus, comprising:

a first ink jet print head configured to eject ink drops on a first receiver region of one or more receivers;

a second ink jet print head configured to eject ink drops on a second receive region of one or more receivers; and a first maintenance station configured to provide maintenance to the first ink jet print head while the second ink jet print head ejects ink drops on the first receiver region or the second receiver region.

Implementations of the system may include one or more of the following. A method for ink jet printing includes moving one or more receivers along a printing pass, ejecting ink drops from a first ink jet print head on a first receiver region of the one or more receivers in the printing pass, ejecting ink drops from a second ink jet print head on a second receiver region of the one or more receivers in the printing pass, and providing maintenance to the first ink jet print head while the second ink jet print head ejects ink drops on the first receiver region or the second receiver region. The method can also include providing maintenance to the first ink jet print head in response to the detection of one or more properties of the first ink jet print head. The method can also include providing maintenance to the second ink jet print head while the first ink jet print head ejects ink drops on the first receiver region or the second receiver region. The method can also include receiving a first set of digital data by the first ink jet print head to control the ejection of ink drops from the first ink jet print head and receiving a second set of digital data by the second ink jet print head to control the ejection of ink drops from the second ink jet print head. The method can also include altering the first set of digital data sent to the first ink jet print head in response to a maintenance call to the first ink jet print head and altering the second set of digital data sent to the second ink jet print head in response to the maintenance call to the first ink jet print head. The first receiver region can be the same as the second receiver region. The first receiver region and the second receiver region can be on different receivers. The method can also include forming a first ink pattern by the first ink jet print head and forming a second ink pattern by the second ink jet print head to produce an ink image on the first receiver region. The method can also include forming a first ink image by the first ink jet print head on the first receiver region and forming a separate second ink image by the second ink jet print head on the first receiver region. The method can also include causing relative movement between the first ink jet print head and a print head maintenance station to provide maintenance to the first ink jet print head includes. The method can also include cleaning or purging nozzles from which the ink drops are ejected.

Implementations of the system may include one or more of the following. An ink jet printing apparatus includes a first ink jet print head configured to eject ink drops on a first receiver region of one or more receivers, a second ink jet print head configured to eject ink drops on a second receive region of one or more receivers; and a first maintenance station configured to provide maintenance to the first ink jet print head while the second ink jet print head ejects ink drops on the first receiver region or the second receiver region. The ink jet printing apparatus can also include a control unit operatively coupled to the first ink jet print head, the second ink jet print head, and the first maintenance station. The control unit is configured to send signals to the first ink jet print head and the second ink jet print head to control the ejection of ink drops and to send signals to the first maintenance station to control the maintenance operations for the first ink jet print head. The ink jet printing apparatus can also include a second maintenance station configured to provide maintenance to the second ink jet print head while the first ink jet print head ejects ink drops on the first receiver region or the second receiver region. The first receiver region can be the same as the second receiver region. The first ink jet print head can form a first ink pattern on the first receiver region and the second ink jet print head can form a second ink pattern on the first receiver region to produce an ink image on the first receiver region. The first ink jet print head can form a first ink image on the first receiver region and the second ink jet print head can form a separate second ink image on the first receiver region. The ink jet printing apparatus can also include a first mechanism configured to cause relative movement between the first receiver region and the first ink jet print head and a second mechanism configured to cause relative movement between the second receiver region and the second ink jet print head. The ink jet printing apparatus can also include a transport mechanism configured to cause relative movement between the first ink jet print head and the first print head maintenance station to provide maintenance to the first ink jet print head includes. The first maintenance station can clean or purge nozzles in the first ink jet print head.

Embodiments may include one or more of the following advantages. The disclosed ink jet system can provide effective arrangements for print head maintenance. Some print heads in the system can continue printing while one or more other print heads are undergoing maintenance. The throughput of the system can therefore be increased. The maintenance of the print heads can be dynamically conducted in response to the need of the print heads. Digital data sent to the print heads can be automatically re-routed to the print heads in response to the maintenance call. The disclosed system and methods are applicable to a plurality of print heads, and a plurality of groups of ink jet print heads such as a page-wide assembly of ink jet print heads.

The details of one or more embodiments are set forth in the accompanying drawing and in the description below. Other features, objects, and advantages of the invention will become apparent from the description and drawings, and from the claims.

DETAILED DESCRIPTION

Figure 1:
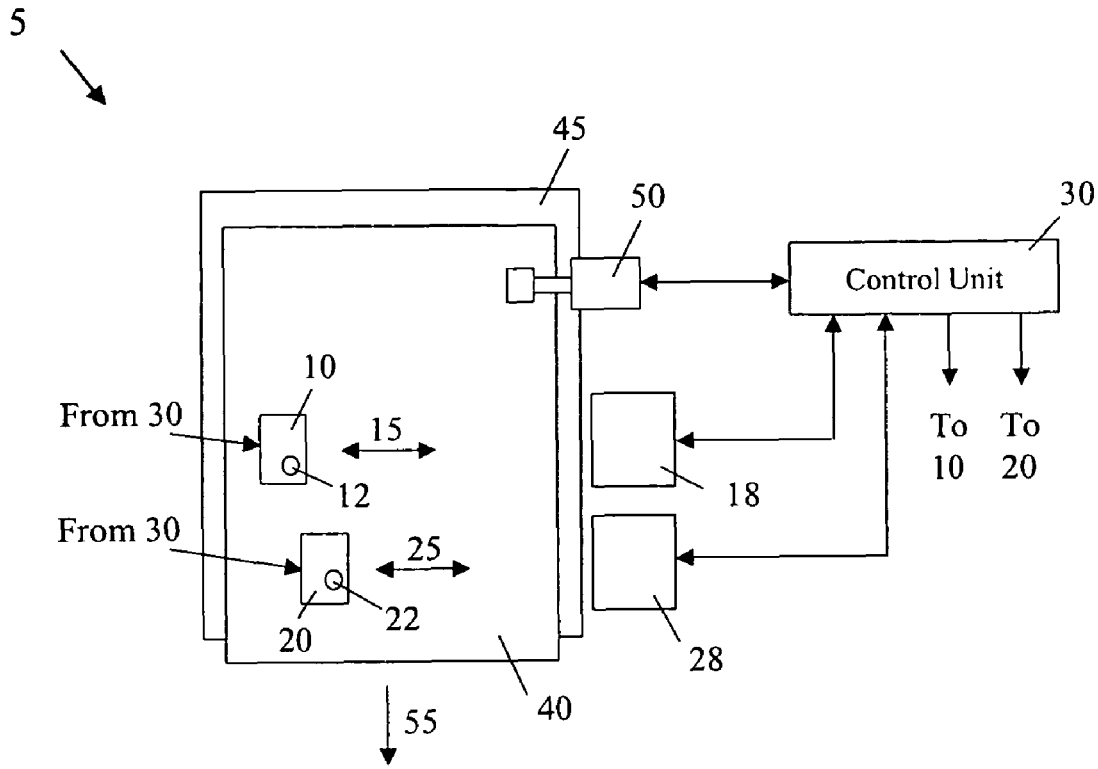
FIG. 1 illustrates the printing mode of an ink jet printing system including a plurality of ink jet print heads and plurality of maintenance stations.

FIG. 1 shows an ink jet printing system 5 including a first ink jet print head 10, a first maintenance station 18, a second ink jet print head 20, a second maintenance station 28, and a controller unit 30. The ink jet printing system 5 may also include an ink reservoir (not shown) for supplying ink through a fluid conduit to the first ink jet print head 10 and the second ink jet print head 20.

The controller unit 30 provides image data and other digital data to the first ink jet print head 10 and the second ink jet print head 20 to enable the print heads to eject ink drops to form an ink image on a receiver 40.

The first ink jet print head 10 can be transported by a first head transport mechanism (not shown for clarity reason) along the direction 15. The first ink jet print head 10 can scan across the receiver 40 and eject ink drops to the receiver 40 under the control of the control unit 30. The first ink jet print head 10 can also be moved by the first head transport mechanism to the first maintenance station 18 for print head maintenance.

The second ink jet print head 20 is transported by a second head transport mechanism (not shown for clarity reason) along the direction 25, which can be parallel to the direction 15. The second ink jet print head 20 can scan across the receiver 40 and eject ink drops to the receiver 40 under the control of the control unit 30. The second ink jet print head 20 can be moved by the second head transport mechanism to the second maintenance station 28 for print head maintenance.

The receiver 40 can be a single sheet placed over a platen 45. The receiver 40 may also include a roll of paper that is fed into the ink jet printing system 5. The receiver 40 can be transported along a printing pass in the direction 55 by a receiver transport mechanism 50 under the control of the control unit 30. Relative to the receiver movement direction 55, the first ink jet print head 10 is disposed upstream to the second ink jet print head 20. During printing, the receiver (e.g., a roll) or series of receivers (e.g., discrete single sheets) can be fed into and pass continuously along the print path.

Receivers compatible with the present invention include paper or man made image receivers for displaying images including opaque, translucent, or transparent materials. The receivers can also include foods such as cookies, candies, and cakes. The receivers can also comprise plastics, ceramics, stone, metallic substrate, wood, and fabrics.

The ink print heads 10, 20 and the print heads are positioned on the print to span the same area on each receiver passing on the print path and are capable of printing on the same portion of each receiver. Both print heads can print to the same set of pixel locations (e.g., the same set of pixels along a printing line) on each receiver. However, in normal operation the ink print heads can print over different portions.

The control unit 30 sends a first set of digital data to enable the first ink jet print head 10 to eject ink drops to form a first ink pattern on a portion of one or more receivers 40. Similarly, the control unit 30 sends a second set of digital data to enable the second ink jet print head 20 to eject ink drops to form a second ink pattern on a different portion of one more of the receivers 40.

Assuming that the ink print heads print on the same receiver, when none of the ink jet print heads is in maintenance service, both the first ink jet print head 10 and the second ink jet print head 20 can print simultaneously on the receiver 40. However, it is also possible for the ink print heads to alternate, e.g., if the controller instructs the print heads to print on alternate receivers.

In normal operation, the ink jet print heads 10, 20 print ink patterns that do not overlap. However, the ink patterns can be located such that the combination of the ink patterns forms the complete image on the receiver. For example, the ink patterns can be placed in the same region of a receiver (e.g., in this case the portions are located in the same region) or in different regions of one or more ink receivers (in this case the portions are located in different regions). Alternatively, the ink patterns can be located on different receivers, such that the each ink patterns forms a complete image on a receiver.

As an example of ink patterns overlapping in the same region of a receiver, the first and second ink patterns are printed on the same line but different pixels (e.g., alternating pixels) of the image as the receiver passes along the print path. As an example of ink patterns in different regions, the first and second ink patterns be alternate lines of an image. As an other example of ink patterns in different regions and on different receivers, the first and second ink patterns can be printed on alternate receivers.

In one implementation, the first ink pattern produced by the first ink jet print head 10 can be a checker board pattern that is complimentary to a checker board pattern produced by the second ink jet print head 20. The final ink image produced on the receiver 40 will comprise a superposition of the first ink pattern and the second ink pattern produced by each of the ink jet print heads 10, 20.

Figure 2:
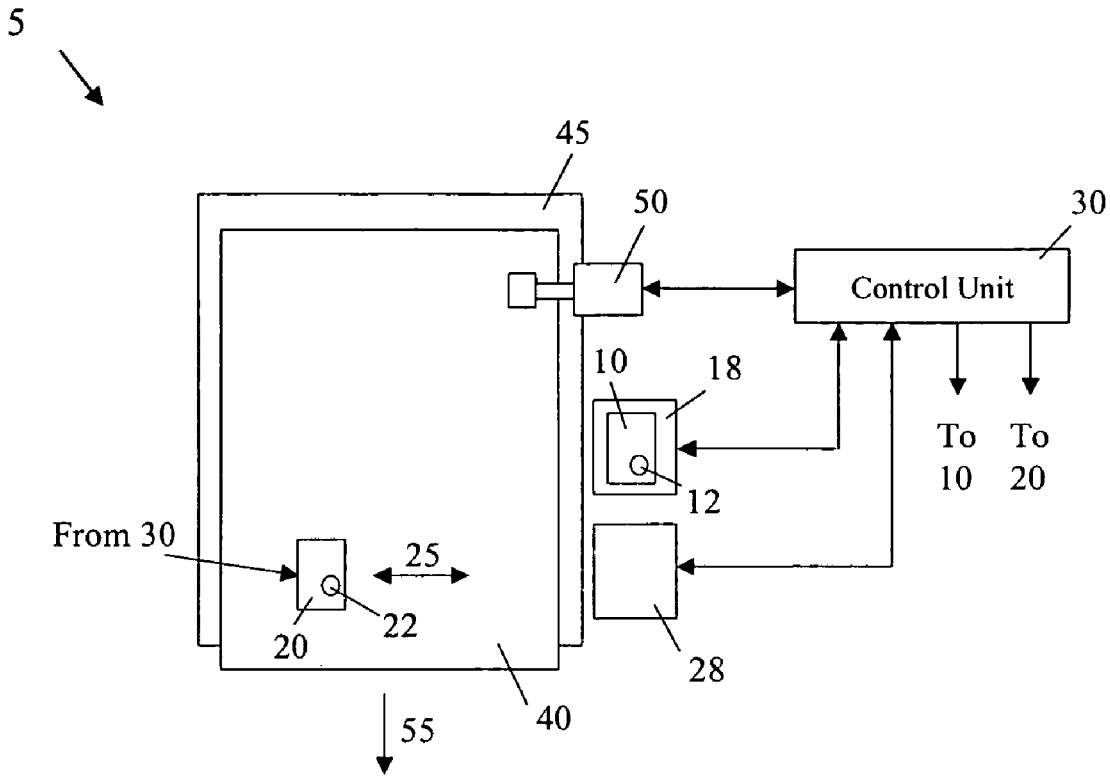
FIG. 2 illustrates the ink jet printing system of FIG. 1 wherein one of the ink jet print heads is under maintenance in one of the maintenance stations.

As shown in FIG. 2, the redundancy of the ink jet print heads 10,20 allows the a subset of the ink jet print heads to be maintained while the other ink jet print head(s) continues to print. Maintenance calls can be scheduled to the first ink jet print heads at pre-calculated time spans. The maintenance calls can also be dynamically made in response to the status or the properties of the print heads. In one embodiment, the ink jet print heads 10,20 comprise respectively a sensor 12 and a sensor 22 that can each detect one or more properties of the ink jet print heads that may affect the ejection of the ink drops from the nozzles. For example, the sensor 12 and the sensor 22 can detect the trajectories of the ink drops ejected from the ink nozzles, the debris or ink accumulated over the nozzle plate during printing, or the air bubbles in the ink fluids in the ink actuation chambers and ink supply conduit. Maintenance calls can be made to the first ink jet print head 10 or the second ink jet print heads 20 after certain properties have been detected or passed a threshold value.

Still referring to FIG. 2, the first ink jet print head 10 is moved by the first head transport mechanism to the first maintenance station 18 after the maintenance call. Various maintenance operations performed at the first maintenance station 18 can include cleaning a nozzle plate and the ink ejection nozzles, wiping of the nozzle plate, purging ink fluid out of the ink nozzles, and firing ink drops from the ink nozzles.

Before a print head is called to maintenance, the digital data sent to the ink jet print heads from the control unit 30 may need to be altered. For example, without the maintenance call, both ink jet print heads are printing. Each of the two ink jet print heads can print a subset of ink dot patterns that together can combine and form an ink image on the receiver 40. If the first ink jet print head 10 may be dynamically called to maintenance in response to signals detected by sensor 12, the digital data sent to the first ink jet print head 10 and the second ink jet print head 20 need to be altered so that the second ink jet print head 20 can take over the task of printing all the ink patterns for the ink image until the first ink jet print head 10 resumes its printing after the maintenance. Similar coordination takes place when the second ink jet print head 20 is called to maintenance by its maintenance station 28. The dynamic maintenance call and the automatic and seamless data re-routing to the ink jet print heads allow the maximum printing throughput for each specific head maintenance requirement.

The printing operation is not interrupted when one of the print heads needs to be maintained. In particular, one print head can be maintained locally or even removed without stopping passage of the receiver(s) along the print path or even stopping printing by the other print head. While the print head is undergoing maintenance, the other print head prints on both its own portion and the portion normally assigned to the print head being maintained. Consequently, either print head can be ready to take over printing from the other print head (which is better than having a redundant head set idle until it is needed), printing need not be not stopped or interrupted, and there need not be any loss in image quality during maintenance.

In another embodiment, the ink jet print heads 10, 20 can print separate ink images on the same or a different receiver in a non-maintenance mode. One ink jet print head will simply skip (i.e. print blank image) over the areas of the receiver that has been or to be printed by another print head. The ink images printed on the same receiver can be cut into separate ink images later. The two ink jet print heads can simultaneously print alternate ink images. For example, the first ink jet print head 10 prints odd ink images while the second ink jet print head 20 prints even ink images simultaneously, which in combination produces a continuous flow of ink jet printing. In another embodiment, the two ink jet print heads can simultaneously print alternate swaths of a same ink image. The swaths printed by the two print heads can stitch together to form the final ink image.

When an ink jet print head needs maintenance, its print load would be transferred to the other print head or print heads seamlessly so that the print head can be withdrawn and maintained without halting the printing process or producing any defects in the printed image. In the case of two print heads printing alternate even/odd ink images, the ink jet printing system 5 can re-route the digital image data to the two ink jet print heads from the alternating mode (i.e. odd images to the first print head; even images to the second print head) to sending all the image data to the second print head to free up the first print head for maintenance. In the switch-over of the printing modes, the remaining odd images buffered at the first print head are printed or deleted before the second print head takes over printing all the ink images. In another implementation of the print-mode switchover, the print head upstream (e.g. the first ink jet print head 10 in FIG. 1) is the first print head to change. The print head downstream (e.g. the first ink jet print head 20 in FIG. 1) continues in its former printing mode until image data of the next printing mode reaches it.

In another embodiment, there can be two or more groups (or clusters) of ink jet print heads. The ink jet print heads in each cluster are stitched together and can print ink patterns that can weave into a common ink image on a receiver. The clusters of heads can be transported along the fast scan direction as shown in FIG. 1. The clusters of heads can also form a page-wide print bar that can print across an ink receiver from edge to edge in a single pass.

When a print head within a first cluster of print heads is determined in need of a maintenance call, the entire first cluster of print heads are moved to a maintenance station. The printing tasks of the first cluster of print heads are taken over by a second cluster of print heads. Alternatively, the particular print head that needs to be maintained in the first cluster of print heads is switched out. The printing tasks of the particular print head are taken over by a counterpart print head in the second cluster of print heads. The rest of the print heads in the first cluster can still print as if in normal printing mode.

The system described is applicable to more than two ink jet print heads and respective associated maintenance stations. In generally, for N print heads, each print bears about 1/N of the throughput. The described system and methods can enable seamless switches from N heads printing to N-M heads printing and M print heads in maintenance (wherein M, N are positive integers; $N \geqq 2$; and $M<N$). The timely or regularly scheduled maintenance and the load sharing amongst the N print heads also increase the lifetime of the print heads.

The above described system and methods provide efficient means for operating and maintaining ink jet print heads. The printing throughput is multiplied by a plurality of ink jet print heads that can simultaneously print. The print heads can also be continually tested for the need for maintenance. When problems start to become visible or on a scheduled basis, a print head can be switched out, maintained, and switched back in, whereas at least another print head continues to print.

What is claimed is:

1. A method for printing, comprising:

moving one or more receivers along a printing pass;

ejecting fluid drops from a first print head on a first receiver of one or more receivers to form a first ink pattern on the first receiver;

ejecting fluid drops from a second print head on a second receiver of the one or more receivers to form a second ink pattern on the second receiver, the first and second receivers being different receivers and the first and second print heads printing on alternate receivers; and providing maintenance to the first print head while the second print head ejects fluid drops on the first receiver and the second receiver.

2. The method of claim 1, further comprising providing maintenance to the second print head while the first print head ejects fluid drops on the first receiver and the second receiver.

3. The method of claim 1, further comprising:

receiving a first set of digital data by the first print head to control the ejection of fluid drops from the first print head; and receiving a second set of digital data by the second print head to control the ejection of fluid drops from the second print head.

4. The method of claim 3, further comprising:

altering the first set of digital data sent to the first print head in response to a maintenance call to the first print head; and altering the second set of digital data sent to the second print head in response to the maintenance call to the first print head.

5. The method of claim 1, further comprising causing relative movement between the first print head and a print head maintenance station to provide maintenance to the first print head.

6. The method of claim 1, wherein providing maintenance to the first print head includes cleaning or purging nozzles from which the fluid drops are ejected.

7. A method for printing an image on a receiver, comprising:

moving one or more receivers along a printing pass;

receiving a first set of digital data by a first print head;

in response to the first set of data, ejecting fluid drops from the first print head on a first receiver of the one or more receivers to form a first ink pattern on the first receiver;

receiving a second set of digital data by a second print head;

in response to the second set of data, ejecting fluid drops from the second print head on a second receiver of the one or more receivers to form a second ink pattern on the second receiver, the first and second receivers being different receivers and the first and second print heads printing on alternate receivers;

altering the first set of digital data sent to the first print head in response to a maintenance call to the first print head;

altering the second set of digital data sent to the second print head in response to the maintenance call to the first print head; and providing maintenance to the first print head while the second print head ejects fluid drops on the first receiver and the second receiver.

8. The method of claim 7, wherein ejecting fluid drops from the first print head on a first receiver includes moving the first print head perpendicular to the direction of motion of the receiver on the printing pass, and wherein ejecting fluid drops from the second print head on a first receiver includes moving the second print head perpendicular to the direction of motion of the receiver on the printing pass.

9. A method for printing, comprising:

moving one or more receivers along a printing pass;

ejecting fluid drops from a first group of print heads on a first receiver of the one or more receivers to form a first ink pattern on the first receiver;

ejecting fluid drops from a second group of print heads on a second receiver of the one or more receivers to form a second ink pattern on the second receiver, the first and second receivers being different receivers and the first and second groups of print heads printing on alternate receivers; and providing maintenance to at least one print head in the first group of print heads while the rest of the print heads in the first group of print heads eject fluid drops on the first receiver and the second group of print heads eject fluid drops on the second receiver.

10. A printing apparatus, comprising:

a first print head configured to eject fluid drops on a first receiver of one or more receivers to form a first ink pattern on the first receiver;

a second print head configured to eject fluid drops on a second receiver of one or more receivers to form a second ink pattern on the second receiver, the first and second receivers being different receivers and the first and second print heads being configured to print alternately on alternate receivers; and a first maintenance station configured to provide maintenance to the first print head while the second print head ejects fluid drops on the first receiver and the second receiver.

11. The printing apparatus of claim 10, further comprising a second maintenance station configured to provide maintenance to the second print head while the first print head ejects fluid drops on the first receiver and the second receiver.

12. The printing apparatus of claim 10, further comprising a control unit operatively coupled to the first print head, the second print head, and the first maintenance station, wherein the control unit is configured to send signals to the first print head and the second print head to control the ejection of fluid drops and to send signals to the first maintenance station to control the maintenance operations for the first print head.

13. The printing apparatus of claim 10, further comprising a first mechanism configured to cause relative movement between the first receiver and the first print head and a second mechanism configured to cause relative movement between the second receiver and the second print head.

14. The printing apparatus of claim 10, further comprising a transport mechanism configured to cause relative movement between the first print head and the first print head maintenance station to provide maintenance to the first print head.

15. The printing apparatus of claim 10, wherein the first maintenance station cleans or purges nozzles in the first print head.

16. The method of claim 1, wherein providing maintenance to the first print head is performed in response to detection of one or more properties of the first print head, and the property to be detected is selected from the group consisting of trajectories of the fluid drops ejected from nozzles of the first print head, presence of debris or ink accumulated over a first nozzle plate of the first print head, and presence of air bubbles in fluids in the first print head.

17. The printing apparatus of claim 10, wherein providing maintenance to the first print head is performed in response to detection of one or more properties of the first print head, and the property to be detected is selected from the group consisting of trajectories of the fluid drops ejected from nozzles of the first print head, presence of debris or ink accumulated over a first nozzle plate of the first print head, and presence of air bubbles in fluids in the first print head.

18. The printing apparatus of claim 17, wherein the print head comprises a sensor to detect the one or more properties of the first print head.

* * * * *